United States Patent [19]

Malone

[11] Patent Number: 4,502,712

[45] Date of Patent: Mar. 5, 1985

[54] TIME CARD BLOTTER

[76] Inventor: Harold H. Malone, 3900 E. Waterman, Wichita, Kans. 67218

[21] Appl. No.: 458,575

[22] Filed: Mar. 9, 1983

[51] Int. Cl.[3] ..... B41L 1/20; B41L 1/74; B41L 3/00

[52] U.S. Cl. ..... 282/22 A; 282/23 R; 281/25 A

[58] Field of Search ..... 281/16, 25 A, 29, 35; 282/23 R, 23 A, 22 R, 22 A, 24 R, 24 A, 24 B, 24 C, 11, 8 B, 25 A

[56] References Cited

U.S. PATENT DOCUMENTS

| | | | |
|---|---|---|---|
| 1,912,717 | 6/1933 | Lawson | 282/22 A |
| 2,092,127 | 9/1937 | Lankton | 282/23 R |
| 2,216,706 | 10/1940 | Freundlich | 281/25 A |
| 2,757,900 | 8/1956 | Moss | 282/23 R |
| 3,116,941 | 1/1964 | Malone | 282/23 R |
| 3,177,010 | 4/1965 | Stroh | 282/23 R |
| 3,233,918 | 2/1966 | Tathwell | 282/23 R |
| 3,257,129 | 6/1966 | Malone | 282/23 R |
| 3,620,553 | 11/1971 | Donovan | 282/8 C |
| 3,734,543 | 5/1973 | Donovan | 282/23 R |

*Primary Examiner*—Paul A. Bell

*Assistant Examiner*—Paul M. Heyranasr

*Attorney, Agent, or Firm*—John H. Widdowson

[57] ABSTRACT

A time card blotter having a plurality of recording and/or ledger sections with each section having a lower permanent record portion; a top cover leaf; a bottom cover leaf; and a binder for binding together the top cover leaf, the recording and/or ledger sections, and the bottom cover leaf. The top cover leaf has a structure defining a weakened score line traversing the width thereof for folding the top cover leaf in half and pivoting the same around the binder for storing the permanent record portion of the recording and/or ledger sections on the top cover leaf between the folded portions thereof. The bottom cover leaf also has a structure defining a weakened score line traversing the width thereof for folding the bottom cover leaf in half to pivot the folded same around the binder for inserting the folded half of the bottom cover leaf in between the underside of the permanent record portion of the recording and/or ledger sections being written on by writing pressure thereabove and the topside of an underlying recording and/or ledger section to protect the remaining recording and/or ledger sections from writing pressure from above.

13 Claims, 12 Drawing Figures

TIME CARD BLOTTER

BACKGROUND OF THE INVENTION

1. Field of the Invention

This invention relates to an improved time card blotter.

2. Description of the Prior Art

U.S. Pat. No. 4,295,664 by Cutting discloses a medication record keeping package wherein pressure sensitive transfer sheets are stacked beneath the cover sheet to provide duplicate records of the information recorded on the original sheet.

U.S. Pat. No. 3,170,719 by Kraus discloses a record keeping for bowling, or the like, wherein there is an original sheet that is treated on the reverse side thereof to transfer writing from the original sheet to the next succeeding sheet.

U.S. Pat. No. 2,668,065 by English et al teaches a plurality of record keeping forms which does not include pressure sensitive adhesive on the back side thereof.

U.S. Pat. No. 3,177,010 by Stroh discloses employee sheets of the accounting set which have a layer of adhesive applied to the left edges thereof to detachably hold the sheets in a selfcontained unit.

My U.S. Pat. No. 3,116,941 discloses a time card blotter having a sheet of carbon paper sandwiched between the original sheet and the duplicate sheet. The three sheets are glued together at the top and bottom to form a set. There are cross perforations on the original sheet which is gummed. The first and the last perforation form a stub at the top and at the bottom of the sheet. When the sheet has been filled in, these two stubs are torn off, leaving the original sheet and the duplicate sheet as separate sheets. The carbon sheet remains attached to the bottom stub and is thrown away. The sets are padded together. Writing on the top sheet carries through to underlying sheets. To protect the underlying sheets, a cardboard or heavy plastic sheet has to be inserted under the sets being written on. These inserts have to be applied in the pad when the sheets are turned and is preferably accomplished by placing a clamp at the top of the pad or by placing the pad in a clipboard. When the sets are disassembled, the duplicate sheet is placed in another book, preferably a ring binder where the duplicates are accumulated as a permanent record. In the time card blotter of my earlier U.S. patent, the top original sheet of the set has to be torn off, and the individual strips separated and classified by client or subject matter. Because the binding is at the top of the pad, it is impractical to remove a single time card strip, since the remaining strips would fall out of the set. Therefore, what is needed and what has been invented by me is an improved time card blotter which does not include the deficencies of my time card blotter in my U.S. Pat. No. 3,116,941; and an improved time card blotter which is not taught or suggested by any of the foregoing prior art.

SUMMARY OF THE INVENTION

It is therefore an object of this invention to provide an improved time card blotter.

Still other objects will be apparent to those skilled in the art from the following description of this invention.

The foregoing objects are achieved according to the practice of this invention. Broadly, this invention comprises a time card blotter having, in combination, a plurality of recording and/or ledger means with each having a lower permanent record portion; a top cover leaf; a bottom cover leaf; and a binding means for binding together the top cover leaf, the recording and/or ledger means, and the bottom cover leaf. The top cover leaf has a structure defining a weakened score line traversing the width thereof for folding the top cover leaf in half and pivoting the same around the binding means for storing the permanent record portion of the recording and/or ledger means in the top cover leaf between the folded portions thereof. The bottom cover leaf also has a structure defining a weakened score line traversing the width thereof for folding the bottom cover leaf in half to pivot the folded same around the binding means for inserting the folded half of the bottom cover leaf in between the underside of the permanent record portion of the recording and/or ledger means being written on by writing pressure thereabove and the topside of an underlying recording and/or ledger means to protect the remaining recording and/or ledger means from writing pressure from above.

BRIEF DESCRIPTION OF THE DRAWINGS

FIG. 4 is the invention in the process of being open for use;

DETAILED DESCRIPTION OF THE INVENTION

Figure 1:
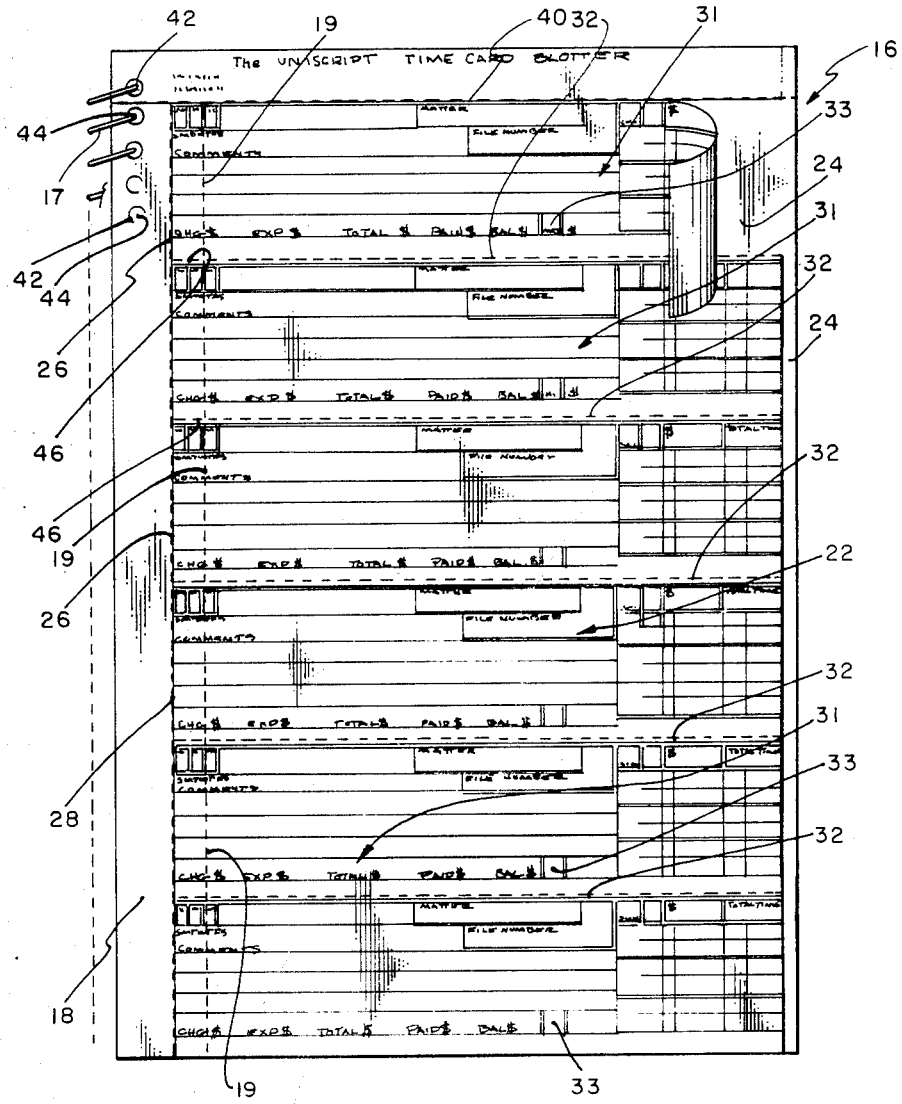
FIG. 1 is a top plan view of the combined border stubs and record leaves arranged in pairs.
Figure 2:
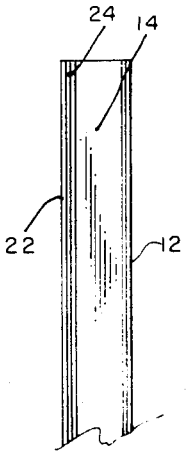
FIG. 2 is a partial vertical sectional view of the invention.
Figure 5:
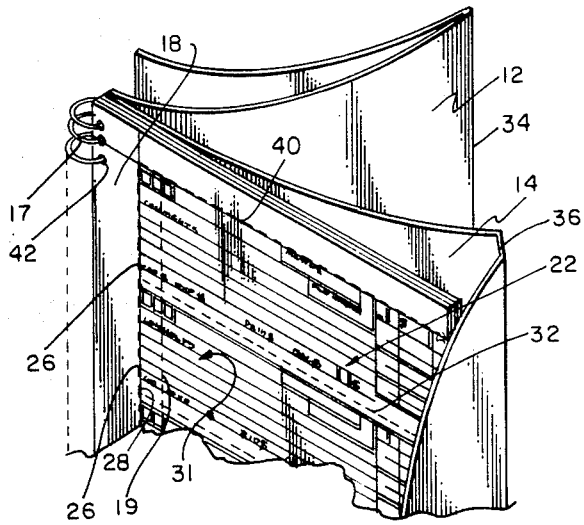
FIG. 5 is a partial perspective view of the invention disclosing the top cover leaf and the bottom cover leaf in the process of being folded away.
Figure 3:
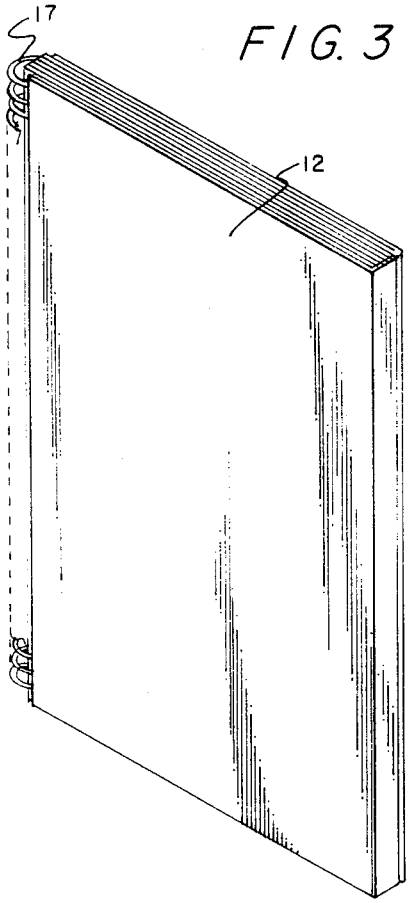
FIG. 3 is the invention in desk use position.
Figure 7:
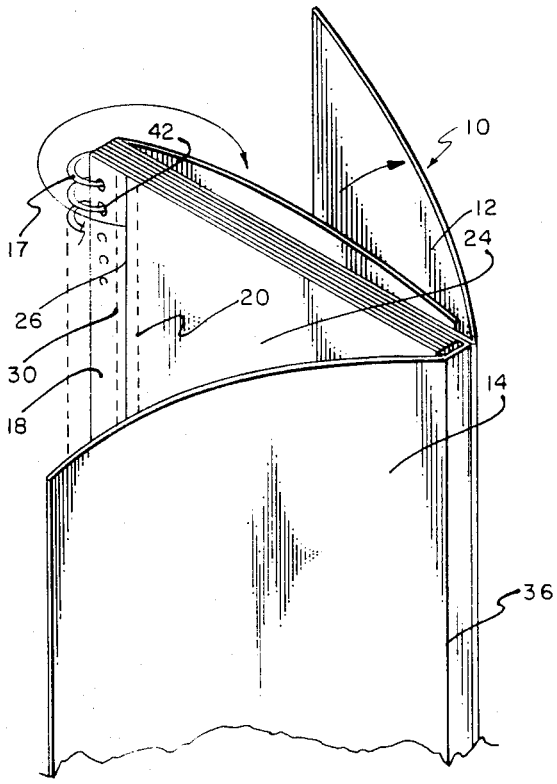
FIG. 7 is a partial perspective view disclosing a written on lower record pressure sensitive sheet being folded into the top cover leaf for storage.
Figure 8:
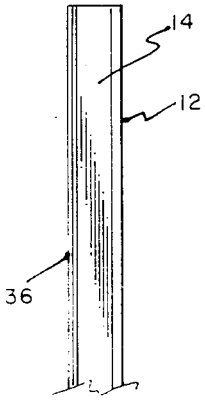
FIG. 8 is a partial side view of the invention.

Referring in detail now to the drawings wherein similar parts of the invention are identified by like reference numerals, there is seen the time card blotter, generally illustrated as 10 in FIG. 7, has a top cover leaf 12; a bottom cover leaf 14; and a plurality of recording and/or ledger means, generally illustrated as 16, which in one embodiment of the invention may be a plurality of superimposed combined border stubs and record leaves arranged in pairs, each combination generally illustrated as 16 and interconnected by an adhesive means in a predetermined order and at certain locations. A spiral binder 17 binds together the top cover leaf 12, and combined border stubs and record leaves 16 or any embodiment of the recording and/or ledger means 15, and the bottom cover leaf 14. Each pair of combined border stubs-record leaves 16 includes a top border stub 18, having edge 19 (see FIG. 1), a lower border stub 20 (see FIG. 7), a top record leaf, generally illustrated as 22, and a lower record pressure sensitive leaf 24, which is preferably a blank page. The top border stub 18 of each pair 16 has a perforate line 26 longitudinally traversing the structure of the top border stub 18. The top record leaf 22 of each pair 16 has an end 28 overlying each of the top border stubs 18 and is secured thereto by the adhesive means. End 28 of leaf 22 generally registers with the perforate line 26 of the border stub 18. The lower record pressure sensitive leaf 24 also has an end 30 (see FIG. 7) which overlies the lower border and is secured thereto by the adhesive means. The adhesive means also secures the top border stub 18 to the lower record pressure sensitive leaf 24 along the edge 30 thereof.

Each of the top record leaves 22 has printed matter for record keeping extending transversely thereacross. The printed matter is repeated at equally spaced intervals each generally represented as 31, a plurality of times from the upper to the lower portion of the top record leaf 22. Each interval of equally spaced repetitive printed matter 31 includes printed indicia 33 for indicating that more comments are to be written about the subject matter of the particular interval of equally spaced repetitive printed matter 31 which is being written on by the user. Parallel rows of perforations 32 extend transversely across the entire width of the top record leaf 22 contiguous to the upper extremities of each of the equally spaced 31 repetiive printed matter.

Figure 6:
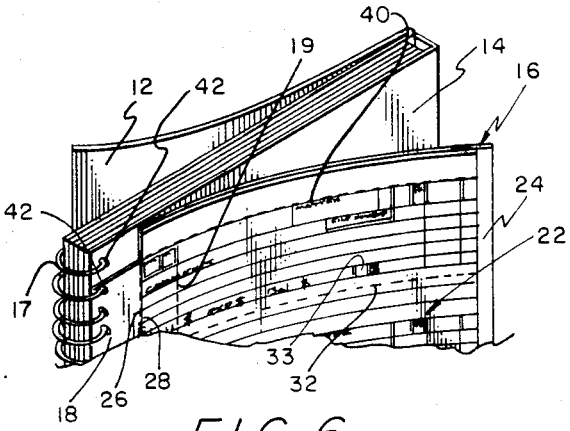
FIG. 6 is a partial perspective view of the invention disclosing the position for writing on a top record leaf with a portion of the bottom cover leaf being folded underneath the corresponding lower record sensitive leaf.
Figure 3:
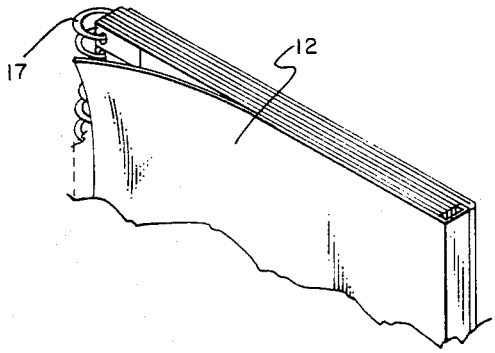

The top cover leaf 12 has a structure defining a weakened score line 34 traversing the width thereof for folding the top cover leaf 12 in half and pivoting it around the spiral binder 17 and over the superimposed combined border stubs and record leaves 16 in order to store as illustrated in FIG. 7 the lower record pressure sensitive leaf 24 (or any lower permanent record portion of any embodiment of the recording and/or ledger means 15) in the top cover 12 between the folded portions thereof after the top record leaf 22 (or the sections 31 thereof) is torn off. The bottom cover leaf 14 also has a structure defining a weakened score line 36 traversing the width thereof for folding the bottom cover leaf 14 in half to pivot it around the spiral binder 17 and under one of the superimposed combined border stubs and record leaves 16 for inserting (as illustrated in FIG. 6) the folded half of the bottom cover leaf 14 in between the underside of a permanent record portion of any means 15 or the lower record pressure sensitive leaf 24 of the two adhesively secured leaves 22 and 24 being written on by writing pressure on the top record leaf 22 thereabove and the topside of any underlying means 15 or the top record leaf 22 of an underlying combined border stubs-record leaves 16 to protect the underlying means 15 or the underlying pressure sensitive leaves 24 from writing pressure from above.

The top border stub 18 and the lower border each has a structure defining a plurality of top border apertures 42 and lower border apertures 44 which are in registry when the adhesive means secures together the top border stub 18, the lower record pressure sensitive leaf 24 and the lower border.

The top border stub 18 additionally comprises parallel rows of top border perforations 46 (see FIG. 1) extending transversly from the perforate line 26 to the edge 19 which underlies the top record leaf 22. The parallel rows of perforations 46 of the top border stub 18 are in registry with a portion of the parallel rows of perforation 32 of the top record leaf 22 such that when one of the equally spaced 31 repetitive printed matter is torn away from the top record leaf 22 along one or two of the parallel rows 32 which extend transversely across the entire width of the top record leaf 22 and along the perforate line 26 which longitudinally traverses the structure of the top border stub 18, a portion of the top border stub 18 remains underneath an end of the repetitive printed matter interval 31 sections which is being torn away from the top record leaf 22. The portion of the top border stub 18 remaining underneath is defined by the area between a pair of parallel rows of perforations 46—46, the edge 19 and the perforate line 26.

Figure 9:
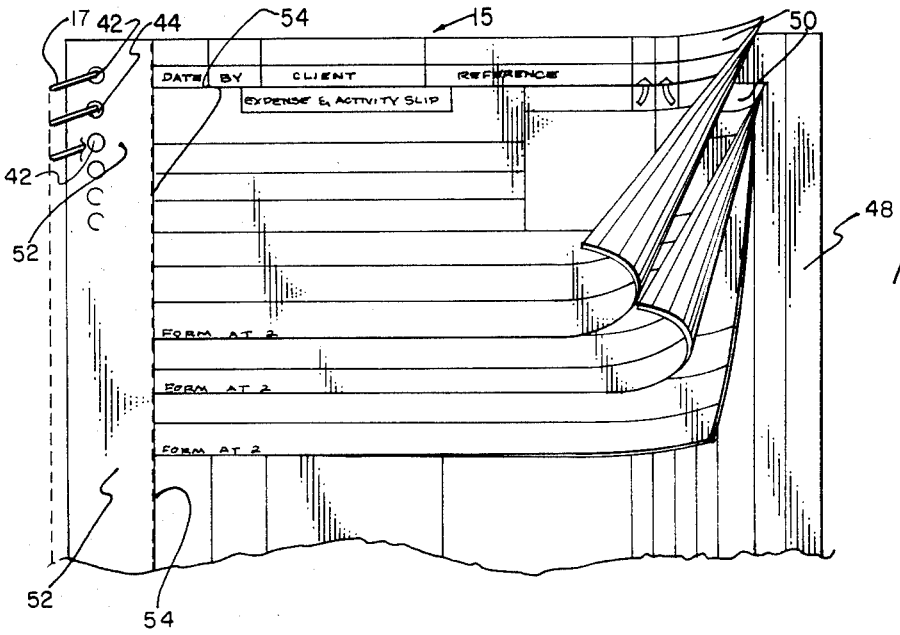
FIG. 9 is another embodiment of the invention which utilizes another record keeping form in combination with the top and bottom cover leaves.
Figure 10:
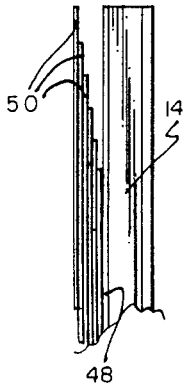
FIG. 10 is a partial side elevational view of the other embodiment of the invention.

The recording and/or ledger means 15 of the time card blotter 10 may also comprise the lower permanent record portion being in the form of a lower record pressure sensitive paper 48 (see FIGS. 9 and 10). A plurality of separable sections 50 of substantially the same size with borders 52 overlap in a shingle type arrangement. The lower record pressure sensitive paper 48 and the plurality of separable sections 50 are secured to the spiral binding 17 and can be arranged such that the folded half of the bottom cover leaf 14 can be inserted underneath the lower record pressure sensitive paper 48 to protect underlying pressure sensitive papers 24 and 48 (see FIG. 10). Each shingle arranged section 50 has printed matter and lines thereon dividing the sections 50 into spaces for record keeping and having informational printing thereon in a predetermined upper extremity space of each of the sections 50 relative to the spaces for recording client and customer information (see FIG. 9). Each of the shingle arranged sections 50 is additionally defined by a perforate line 54 separating the border section 52 from the printed matter and lines which are situated on the remaining portion of the section 50. The border section 52 of each of the shingle arranged sections 50 includes adhesive means thereunder for securing a top portion of the border section 52 to the second lower record pressure sensitive paper 48 and for securing the remaining portion of the border section 52 to the topside of the underlying border section 52 of an underlying section 50 of the shingle arranged sections 50.

The recording and/or ledger means 15 of the time card blotter may also be of the embodiment disclosed in my copending patent application titled "General Journal Form", Ser. No. 447,281 and filed 12/6/82; or of the embodiment taught in my U.S. Pat. No. 3,116,941.

Figure 11:
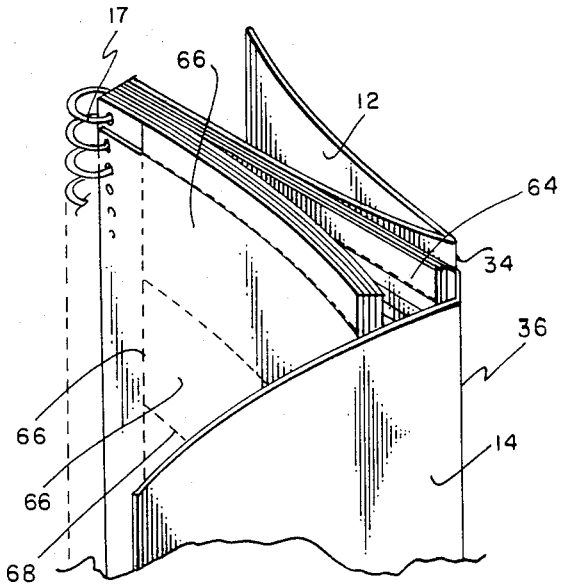
FIG. 11 is a partial perspective view disclosing a top record leaf and supplemental record forms which are perforated to be torn away in order to be put with the primary record forms.
Figure 12:
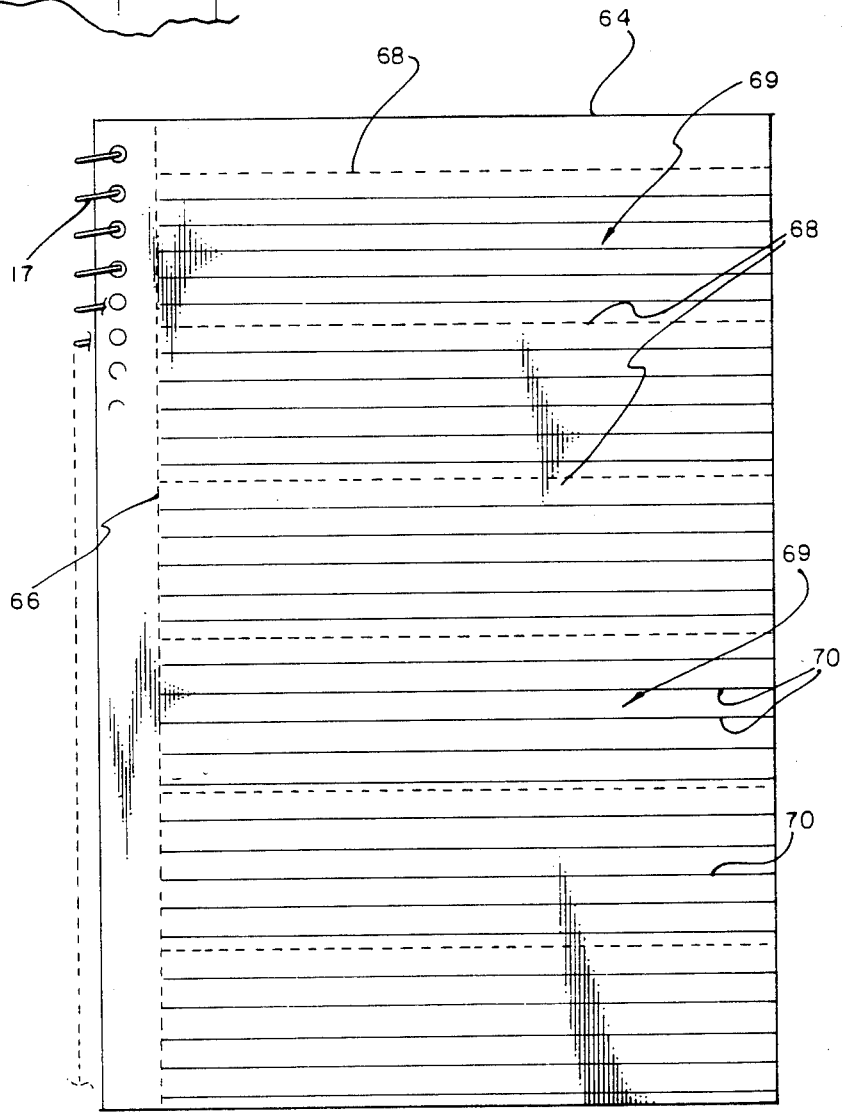
FIG. 12 is a top plan view of the supplemental record form which includes lines printed thereon and perforated in structure.

The time card blotter 10 may additionally include a supplemental record form 64 (see FIGS. 11 and 12) which includes a vertical perforate line 66 and parallel rows of perforations 68 extending from the perforate line 66 to the end of the form 64 to define supplemental sections 69 which may be torn away in order to be put with an equally spaced printed matter interval 31 of a top record leaf 22. The form 64 along with separable sections 50 and sensitive paper 48, may be utilized when printed indicia 33 (preferably "MORE") is checked indicating that more comments are to be written.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A time card blotter comprising in combination recording and/or ledger means having a plurality of superimposed combined border stubs and record leaves arranged in pairs with all pairs stacked in an overlying relationship as pages in a book and with each having a lower permanent record portion; a top cover leaf; a bottom cover leaf; a binding means binding together the top cover leaf, the combined border stubs and record leaves, the recording and/or ledger means, and the bottom cover leaf, adhesive means for interconnecting the border stubs and record leaves in a predetermined order and at certain locations; each pair of combined border stubs and record leaves including a top border stub, a lower border stub, a top record leaf, and said lower permanent record portion which is a lower record pressure sensitive leaf; said top border stub of each pair having a perforate line longitudinally traversing the structure of the top border stub; said top cover leaf having a structure defining a weakened score line traversing the width thereof for folding the top cover leaf in half and pivoting the same around the binding means for storing the permanent record portion of the recording and/or ledger means in the top cover leaf between the folded portions thereof, said top record leaf of each pair having an end overlying each of said top border stubs and secured thereto by said adhesive means and generally registering with said perforate line of said top border stub; said bottom cover leaf also having a structure defining a weakened score line traversing the width thereof for folding the bottom cover leaf in half to pivot the folded same around the binding means for inserting the folded half of the bottom cover leaf in between the underside of the permanent record portion of the recording and/or ledger means being written on by writing pressure thereabove and the topside of an underlying recording and/or ledger means to protect the remaining recording and/or ledger means from writing pressure from above; said lower record pressure sensitive leaf having an end overlying each of said lower border stubs and secured thereto by said adhesive means; each of said top record leaves having printed matter for record keeping extending transversely across said top record leaves, said printed matter being repeated at equally spaced intervals a plurality of times from the upper to the lower portion of said top record leaves; parallel rows of perforations extending transversely across the entire width of said top record leaf contiguous to the upper extremities of each of said equally spaced repetitive printed matter; said top cover leaf being pivoted around the binding means and over the superimposed combined border stubs and record leaves and for storing the lower record pressure sensitive leaves in the top cover leaf between the folded portions thereof after the top record leaf is torn off; said bottom cover leaf being pivoted around the binding means and under the superimposed combined border stubs and record leaves and for inserting the folded half of the bottom cover leaf in between the lower record pressure sensitive leaf of said record leaves being written on by writing pressure on the top record leaf thereabove and a top record leaf of an underlying pair of record leaves to protect the underlying pressure sensitive leaves from writing pressure from above; said adhesive means additionally securing the top border stub to the lower record pressure sensitive leaf along an edge thereof.

2. The time card blotter of claim 1 wherein said plurality of recording and/or ledger means comprises a plurality of superimposed combined border stubs and record leaves arranged in pairs with all pairs stacked in an overlying relationship as pages in a book; said binding means binds together the top cover leaf, the combined border stubs and record leaves, and the bottom cover leaf; adhesive means for interconnecting the border stubs and record leaves in a predetermined order and at certain locations; each pair of combined border stubs and record leaves including a top border stub, a lower border stub, a top record leaf, and said permanent record portion which is a lower record pressure sensitive leaf; said top border stub of each pair having a perforate line longitudinally traversing the structure of the top border stub; said top record leaf of each pair having an end overlying each of said top border stubs and secured thereto by said adhesive means and generally registering with said perforate line of said top border stub; said lower record portion having an end overlying each of said lower border stubs and secured thereto by said adhesive means; each of said top record leaves having printed matter for record keeping extending transversely across said top record leaves, said printed matter being repeated at equally spaced intervals a plurality of times from the upper to the lower portion of said top record leaves; parallel rows of perforations extending transversely across the entire width of said top record leaf contiguous to the upper extremities of each of said equally spaced repetitive printed matter: said top cover leaf being pivoted around the binding means and over the superimposed combined border stubs and record leaves and for storing the lower record pressure sensitive leaves in the top cover leaf between the folded portions thereof after the top record leaf is torn off; said bottom cover leaf being pivoted around the binding means and under the superimposed combined border stubs and record leaves and for inserting the folded half of the bottom cover leaf in between the lower record pressure sensitive leaf of said record leaves being written on by writing pressure on the top record leaf thereabove and a top record leaf of an underlying pair of record leaves to protect the underlying pressure sensitive leaves from writing pressure from above; said adhesive means additionally securing the top border stub to the lower record pressure sensitive leaf along an edge thereof.

3. The time card blotter of claim 1 wherein said pair of combined border stubs and record leaves additionally comprises a top record stub secured to the upper most repetitive printed matter interval of the top record leaf in the form of a top perforate line and said top record stub secured to the lower record pressure sensitive leaf by said adhesive means.

4. The time card blotter of claim 3 wherein the said lower record pressure sensitive leaf defines a blank page.

5. The time card blotter of claim 4 wherein said lower border stub of each pair includes a perforate line longitudinally traversing the structure of the lower border stub.

6. The time card blotter of claim 5 wherein the perforate lines of each of said top border stub and said lower border stub registers with each other when said adhesive means holds together said top border stub, said lower record pressure sensitive leaf and said lower border stub.

7. The time card blotter of claim 6 wherein said top border stub and said lower border stub each has a structure respectively defining a plurality of top border apertures and lower border apertures, said top border apertures and said lower border apertures being in registry when said adhesive means secures together said top border stub, said lower record pressure sensitive leaf and said lower border stub.

8. The time card blotter of claim 7 wherein said top border stub additionally comprises parallel rows of top border perforations extending transversely from said perforate line which longitudinally traverses the structure of the same to the edge of said top border stub which underlies the top record leaf; said parallel rows of perforation of said top border stub being in registry with a portion of tne parallel rows of perforations of said top record leaf such that when one of the equally spaced repetitive printed matter is torn away from the top record leaf along one or two of the said parallel rows of perforations extending transversely across the entire width of said top record leaf and along the perforate line which longitudinally traverses the structure of the top border stub, a portion of the top border stub remains underneath an end of the repetitive printed matter interval section which is being torn away from the top record leaf.

9. The time card blotter of claim 8 additionally comprising adhesive means securing the top record leaf to the lower record pressure sensitive leaf.

10. The time card blotter of claim 8 wherein each interval of equally spaced repetitive printed matter includes printed indicia for indicating that more comments are to be written about the subject matter of the particular interval of equally spaced repetitive printed matter which is being written on by the user.

11. The time card blotter of claim 10 additionally comprising a supplemental record form bound within said time card blotter by said binding means.

12. The time card blotter of claim 11 wherein said supplemental record form is blank.

13. The time card blotter of claim 11 wherein said supplemental record form has lines.

* * * * *